US007963491B2

(12) United States Patent
Schouten

(10) Patent No.: US 7,963,491 B2
(45) Date of Patent: Jun. 21, 2011

(54) SYSTEM AND METHOD FOR STABILIZING VERTICALLY STACKED SHEET MATERIAL

(75) Inventor: Erik Schouten, Lititz, PA (US)

(73) Assignee: RockSteady, LLC, Lititz, PA (US)

( * ) Notice: Subject to any disclaimer, the term of this patent is extended or adjusted under 35 U.S.C. 154(b) by 784 days.

(21) Appl. No.: 11/953,546

(22) Filed: Dec. 10, 2007

(65) Prior Publication Data

US 2009/0146038 A1 Jun. 11, 2009

(51) Int. Cl.
*A47B 96/06* (2006.01)

(52) U.S. Cl. ..... 248/218.4; 248/231.71; 248/309.1; 248/500; 24/380

(58) Field of Classification Search ..... 248/207, 248/218.4, 300, 309.1, 321.71, 499, 500; 52/127.2, 506.01, 749.1, DIG. 1
See application file for complete search history.

(56) References Cited

U.S. PATENT DOCUMENTS

| | | | | |
|---|---|---|---|---|
| 151,282 | A * | 5/1874 | Gudenoge et al. | 248/218.4 |
| 454,111 | A | 6/1891 | Coupe | |
| 1,477,482 | A | 12/1923 | Harpin | |
| 1,955,223 | A | 4/1934 | Brouyette | |
| 2,779,561 | A | 1/1957 | Blundeau | |
| 3,256,630 | A | 6/1966 | Spector | |
| 4,018,301 | A | 4/1977 | Nameche | |
| 4,164,269 | A | 8/1979 | Jackson | |
| 4,333,286 | A | 6/1982 | Weinar | |
| 4,498,272 | A | 2/1985 | Adams | |
| 4,502,619 | A * | 3/1985 | Cox | 224/311 |
| 4,924,971 | A | 5/1990 | Rice | |
| 4,939,821 | A * | 7/1990 | Frank, Jr. | 24/136 R |
| 4,941,547 | A | 7/1990 | Livick | |
| 5,078,231 | A | 1/1992 | Davis | |
| 5,174,543 | A | 12/1992 | Corson et al. | |
| 5,992,114 | A | 11/1999 | Zelinsky et al. | |
| 6,220,562 | B1 | 4/2001 | Konkle | |
| 6,293,058 | B1 * | 9/2001 | Sink | 52/127.1 |
| 6,427,803 | B1 * | 8/2002 | Moore | 182/107 |
| 6,732,981 | B2 * | 5/2004 | Franks et al. | 248/74.1 |
| 7,175,149 | B2 | 2/2007 | Gallien | |
| 7,543,789 | B2 | 6/2009 | Lindberg | |

* cited by examiner

*Primary Examiner* — Terrell McKinnon
*Assistant Examiner* — Daniel J Breslin
(74) *Attorney, Agent, or Firm* — McNees Wallace & Nurick LLC

(57) ABSTRACT

A system and method for stabilizing vertically stacked sheet material is disclosed. The sheet material may be construction wallboard. The system includes a bracket and an elongate flexible link element. The method includes attaching the bracket to the sheet material, attaching the flexible link element to a support structure such as vertical stud framing member, and attaching the flexible link element to the bracket to stabilize the vertically stacked sheet material.

9 Claims, 5 Drawing Sheets

SYSTEM AND METHOD FOR STABILIZING VERTICALLY STACKED SHEET MATERIAL

FIELD OF THE INVENTION

The present invention is generally directed to the stabilization of stored material, and more particularly to a system and method for stabilizing vertically stacked sheets of construction material.

BACKGROUND OF THE INVENTION

One of the most common methods today of constructing walls and barriers includes the use of inorganic wallboard panels or sheets, such as gypsum wallboard, often referred to as wallboard or drywall. The term wallboard as used herein is intended to include construction material of a general flat sheet shape, including but not limited to gypsum wallboard.

North America is one of the largest gypsum wallboard users in the world with a total wallboard plant capacity of 40 billion square feet per year. Moreover, the home building and remodeling markets in North America have increased demand the last five years, with an average new American home containing more than 7 metric tons of gypsum. Additionally, the world market for gypsum as a construction material continues to grow.

Walls and ceilings made with gypsum wallboard panels are conventionally constructed by securing the wallboard with screws, nails, or other similar fasteners to structural members, for example, vertically and horizontally oriented pieces of wood or metal, commonly referred to as studs. Wallboard is typically supplied in standard-sized sheets or panels, and is frequently delivered to a construction site as stacks or bundles of wallboard.

The bundles of wallboard may contain approximately 26 to 30 individual sheets of wallboard. The wallboard is most frequently configured as 4 ft. by 12 ft. sheets, with each sheet weighing approximately 90 lbs. Wallboard is also provided in 4 ft. by 8 ft. and 4 ft by 16 ft. sheets. Thus, bundles of wallboard may weight between approximately 2340 lbs and 2700 lbs. The bundles of wallboard are delivered and stored at the construction site until needed.

At the construction site, the wallboard may be stored by horizontally stacking the wallboard on a horizontal surface, such as a flooring surface, or the wallboard may be vertically stacked, such as against an unfinished wall. The wallboard is often vertically stacked when the wallboard is being stored on a second floor or higher level at a construction site where horizontal storage space is not readily available. The wallboard may also vertically stacked on ground or lower floors if horizontal storage space is not available. The wallboard is often vertically stacked by leaning the wallboard against a stud wall proximate to the location where the wallboard will be installed. It is common practice in the construction industry to vertically stack wallboard with a very small lean angle to prevent damage to the wallboard. Often, the lean angle, the angle from vertical that the wallboard is leaned towards the supporting surface, may be up to approximately 20 degrees from vertical, and may be less than 5 degrees from vertical. The term vertically stacked is intended to encompass lean angles up to approximately 20 degrees from vertical for the remainder of this discussion. The small lean angle creates an unstable stack of wallboard that may be tipped over by a small unintentional force.

The vertically stacked wallboard presents a safety problem at construction sites since the wallboard may be subjected to unintended external forces, such as wind or accidental work site contact, which may cause the wallboard to unintentionally fall away from it's vertically stacked orientation. Because of the wallboard's considerable weight and size, serious personal injury may result from such unintentional movement of the wallboard, either by contacting a person or forcing a person into an unsafe position.

Because the wallboard is used as a wall surface, it is not practical to temporarily fix the wallboard directly to a vertical surface, such as a stud, by nailing or other destructive methods. Furthermore, providing supports and/or structures to temporarily stabilize the wallboard is not practical due to the fast pace at which the wallboard is used.

What is needed is a system and method to stabilize substantially vertically oriented wallboard that is inexpensive and simple to install.

SUMMARY OF THE INVENTION

A first aspect of the disclosure includes a stabilization system for stabilizing a vertically oriented sheet of material including a bracket comprising a front wall, a rear wall, and a top wall disposed between the front wall and the rear wall, the front wall comprising a compliant tab having a first hole therethrough, and a second hole configured to be aligned with the first hole when the compliant tab is folded across the front wall, and an elongated flexible link element.

The front wall of the bracket may include protrusions generally directed towards the bracket rear wall. The rear wall may also include protrusions generally directed towards the front wall. The top wall may include a compliant top tab having a hole.

The elongated flexible link element includes a wire having a wire fastener disposed at one end thereof. The elongated flexible link elements may be a metal wire and the wire fastener comprises an eyelet. In an alternative embodiment, the elongated flexible link element may be a nylon fastener.

The bracket may be metal and may be formed by stamping and forming a metal blank. Alternatively, the bracket may be a plastic or polymer material formed by molding.

A second aspect of the disclosure includes a method for stabilizing a vertically stacked sheet of material including providing a vertically stacked sheet of a material supported against a support surface, mounting a bracket over a top edge of a sheet of the vertically stacked sheet of material, securing an elongated flexible link element to a component of the support surface, and attaching the elongated flexible link element to the bracket to stabilize vertically stacked sheet of material against the support surface. The vertically stacked sheet of a material may be vertically stacked wallboard.

The elongated flexible link element may be routed through a hole in a tab formed in the mounting bracket before the elongated flexible link element is attached to the bracket.

The elongated flexible link element may be a metal wire and a fastener disposed at one end of the metal wire, and the elongated flexible link element is secured to the support surface by a fastener such as a screw, nail or staple. In an alternative embodiment, the elongated flexible link element is a nylon fastener such as a nylon wire tie.

The bracket used in the second aspect of the disclosure includes a front wall, a rear wall, and a top wall disposed between the front wall and the rear wall, the front wall comprising a compliant tab having a first hole therethrough, and a second hole configured to be aligned with the first hole when the compliant tab is folded across the front wall, and protrusions generally directed towards the rear wall.

The front wall of the bracket may further include protrusion generally directed towards the rear wall. The rear wall may include protrusions generally directed towards the front wall.

The method for stabilizing a vertically stacked sheet of material may include two or more brackets to stabilize the vertically stacked sheet of material.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
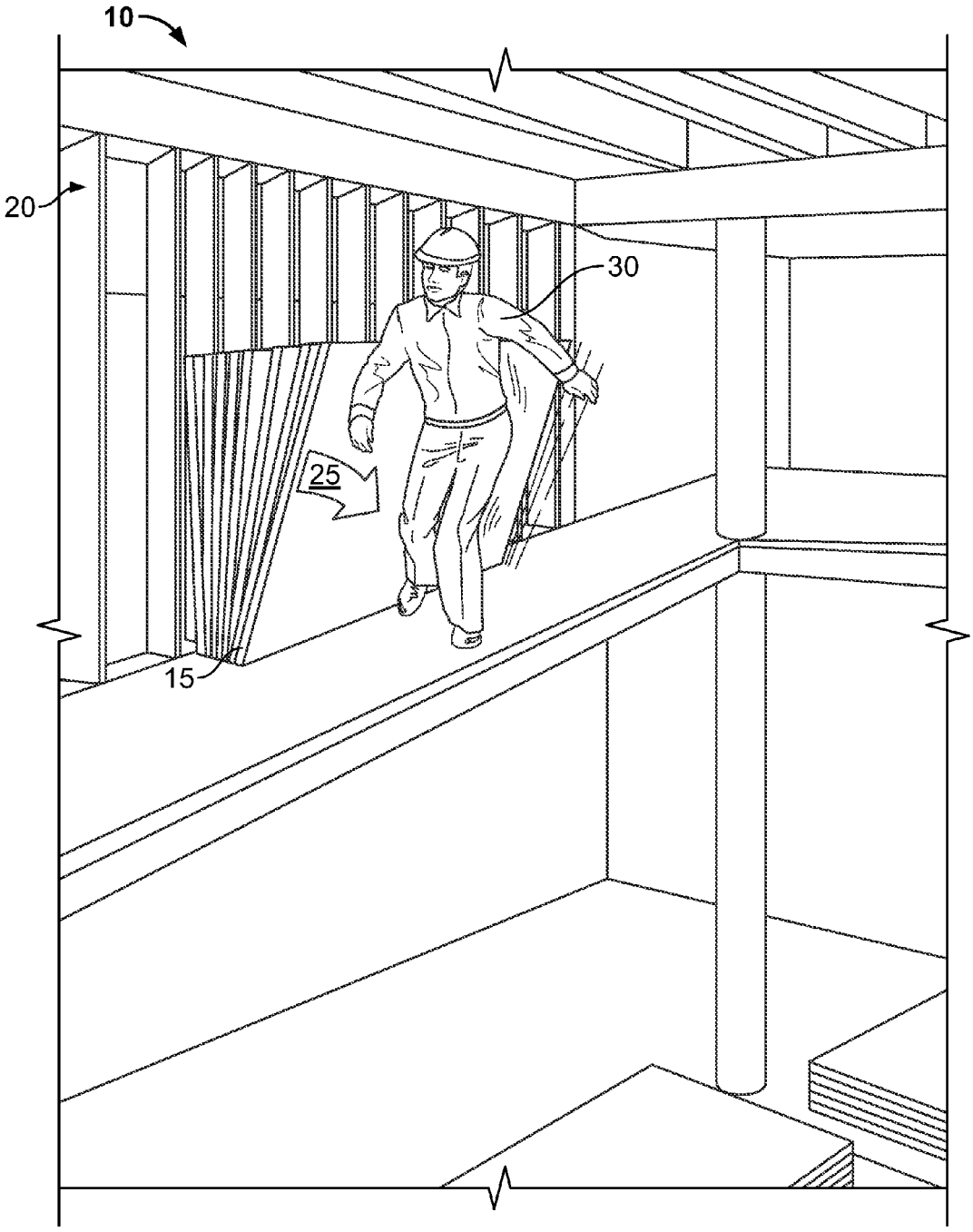
FIG. 1 illustrates of a construction site scenario where the system and method of the invention may be applied.

FIG. 1 shows an illustration of a construction site scenario 10 that may be prevented by the system and method according to the present invention. As can be seen in FIG. 1, a bundle of wallboard 15, which has been vertically stacked against studs 20, has become destabilized and is falling in the direction of the arrow 25. The falling bundle of wallboard 15 is shown as either striking the worker 30 or forcing the worker 30 into an unsafe position.

Figure 2:
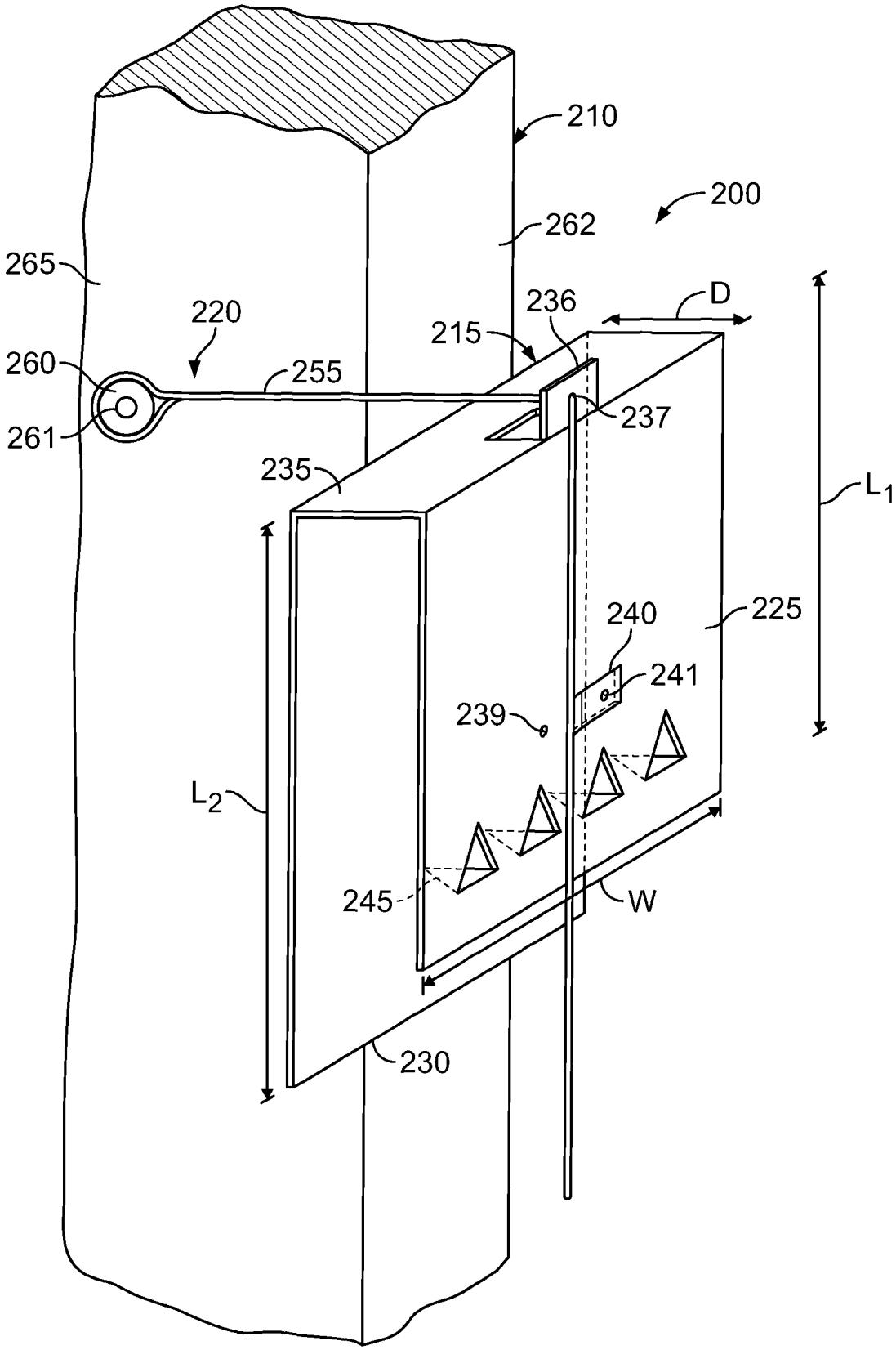
FIG. 2 illustrates an exemplary embodiment of a stabilization system according to the invention.

FIG. 2 illustrates an exemplary embodiment of a stabilization system 200 for stabilizing a substantially vertically stacked bundle of sheet material (not shown) against a wall stud 210 or other similar wall structure. The stabilization system 200 includes a bracket 215 and a flexible link element 220. The bracket 215 includes a front wall 225, a rear wall 230, and a top wall 235 disposed between the top wall 225 and the rear wall 230. The bracket 215 may be metal, such as steel, aluminum or other similar metal, and may be formed by stamping and forming the bracket by conventional metal working methods including stamping, punching, and bending. Alternatively, the bracket may be formed of a plastic or polymer material and formed by conventional plastic molding techniques.

The front wall 225 includes a front hole 239 and a front tab 240. The front tab 240 includes hole 241. The front tab 240 is formed from the front wall 225 by any conventional forming methods including stamping, punching, cutting and other similar methods. In an alternative embodiment, the front tab 240 may be adhered to the front wall 225 by welding or other suitable technique for metal joining. The front tab 240 is compliant and configured to allow the tab 240 to be folded across the front wall 225 so as to align the hole 241 with the front hole 239.

The front wall 225 also includes optional protrusions 245, which have been formed into the front wall 225 by any conventional method including, but not limited to stamping, punching and other similar forming methods. The protrusions are generally directed towards the rear wall 230 as shown in FIG. 2. The protrusions 245 have a generally triangular shape, but other shapes including rectangular, square, circular and other similar shapes may be used. The protrusions 245 are configured to engage sheet material (not shown) when present between the front and rear walls 225, 230. In an alternative embodiment, protrusions 245 may be attached to the front wall 225 by welding or other suitable techniques.

In alternative embodiments of the invention, protrusions 245 may be formed in the rear wall 230 and generally directed towards the front wall 225, the protrusions may be formed in the rear wall 230 in addition to being formed in the front wall 225, or the protrusions may be omitted from both the front wall 225 and the rear wall 230.

The top wall 235 includes an optional top tab 236. The optional top tab 236 includes a hole 237. The optional top tab 236 is disposed proximate to the front wall 225 as shown in FIG. 2. The optional top tab 236 is formed in the top wall 235 by stamping, punching, cutting, or other similar forming method, followed by working to orient the optional front tab 236 substantially perpendicular to the plane of the top wall 235. In alternative embodiments of the invention, the optional top tab 236 may be positioned proximate the rear wall 230, between the front wall 225 and the rear wall 230, or may be deleted.

As shown in FIG. 2, the front wall 225 has a length $L_1$ and a width W. The length $L_1$ may be between about 1 inch to about 5 inches, and more preferably between about 1.5 inches and about 3 inches, and most preferably about 2 inches. As further shown in FIG. 2, the rear wall 230 has a length $L_2$ and a width W, the width W being the same for the front wall 225 and the rear wall 230. The length $L_2$ may be between about 1 inch and about 7 inches, and preferably between about 2 inches and 5 inches, and most preferably about 3 inches. The width W is selected to provide the bracket 210 with sufficient strength and stability to support any sheet material stabilized by the bracket 215. The top wall 235 has a depth D as shown in FIG. 2. The depth D is selected so the bracket 215 can be attached to of a single sheet of wallboard (not shown). For example, if the wallboard has thickness of approximately 0.5 inches, the depth D may be selected to be between greater than about 0.5 inches and about 1 inch, preferably about 0.75 inches. Alternatively, the depth D may be selected so the bracket 210 may be attached to more than one sheet of wallboard (not shown). The dimensions of the bracket 215 may vary considerably, and are dependent upon the thickness of the sheet material and strength of the material chosen to form the bracket 215. The dimensions may be determined by one of ordinary skill in the art based on the sheet material dimensions, bracket material and application so as to minimize the bracket dimensions, which reduce cost, and yet provide the desired degree of stability for the wallboard.

As additionally shown in FIG. 2, the flexible link element 220 attaches the bracket 215 to wall stud 210. The link element 220 includes a wire 255 or cable and a wire fastener 260 disposed at one end of the wire 255. The wire 255 may be a metal or plastic, but preferably is metal. For example, the wire 255 may be a stranded steel wire having a diameter of between about 3/64 inch to about ¼ inch, and preferably be a ⅙ inch diameter 7 strand steel wire, commonly referred to as 7×7 wire having a break strength of about 480 lbs. The wire fastener 260 may be formed of metal, ceramic, or plastic material. The wire fastener 260 includes a hole or eyelet 261 for receiving a fastener such as a fine thread drywall screw, screw, nail, staple or other similar fastener (not shown) for attaching the wire fastener 260 to the stud 210. The wire fastener 260 may be attached to the wire 255 by any conventional methods including crimping, soldering, gluing or other similar methods. In one embodiment, the wire fastener 260 is metal side eyelet fastener that has been crimped onto an end of the wire 255.

In an alternative embodiment of the invention, the flexible link element may be a nylon or other similar plastic or polymer fastener having a wire section and a wire securing element disposed at one end of the wire section. For example, a nylon fastener having a wire section with ratchet serrations on one side and a ratcheting terminal end section may be used. The ratcheting terminal end section may have an aperture provided with a pivoted pawl having teeth that engage the ratchet serrations of the wire when the free end of the strap is passed through the aperture. The nylon fastener may be a wire tie or zip tie as is commonly referred to in the art.

The wall stud 210 includes a front surface 262 and a side surface 265. The wall stud 210 may be formed of wood, metal or other similar construction material.

Figure 3:
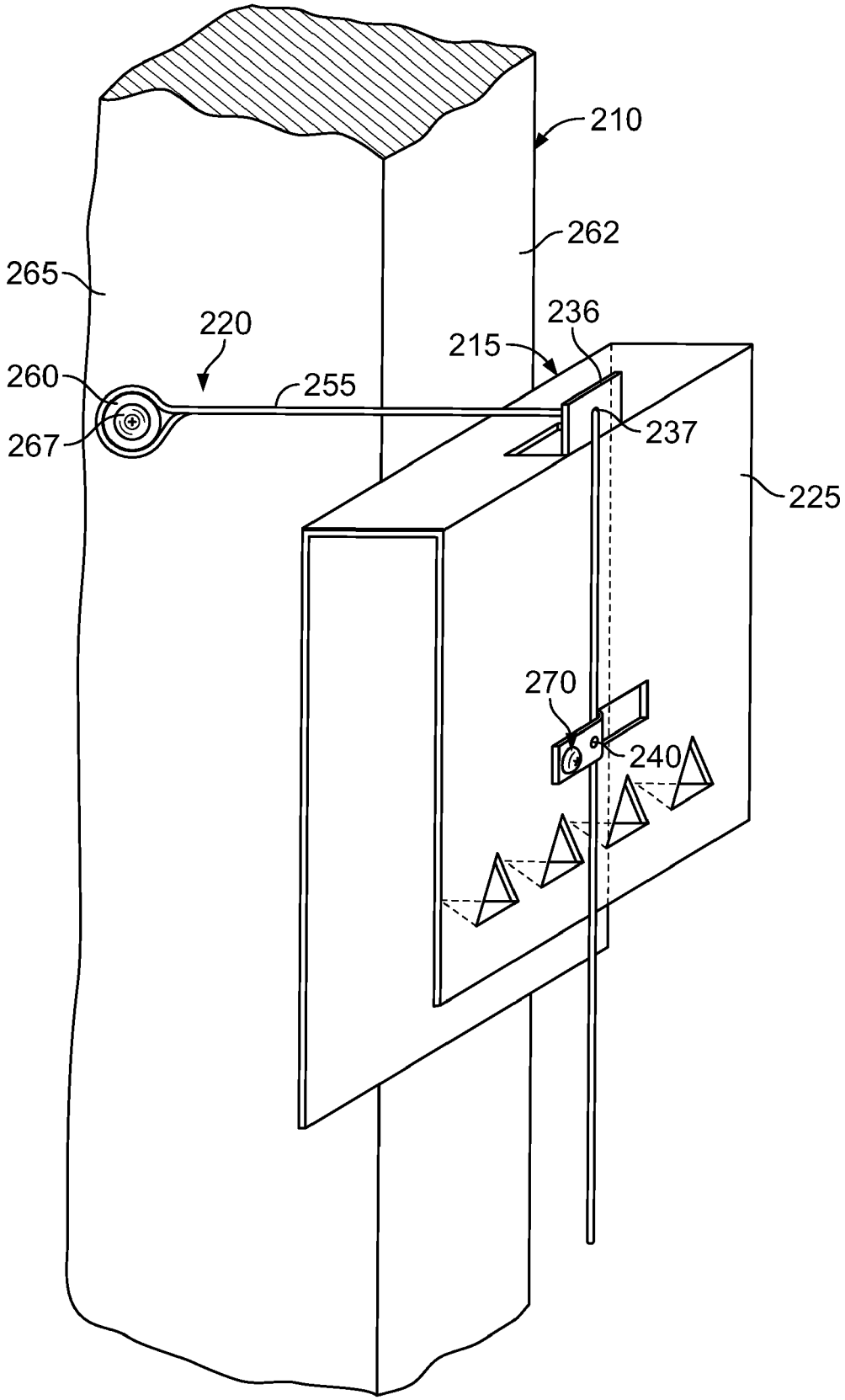
FIG. 3 illustrates the stabilization system of FIG. 2 having the elongated flexible link element attached to the bracket.

Referring to FIG. 3, the link element 220 is attached to the side surface 265 of the wall stud 210 by a fine thread drywall screw 267 or other similar fastener including, but not limited to, nails. The link element 220 is preferably attached to the side surface 265 instead of the front surface 262 to increase retention strength of the stabilization system 200, as would be appreciated by one of ordinary skill in the art. However, in alternate embodiments, the link element 220 may be attached to the front surface 262.

After the link element 220 is attached to the stud 210, the wire 255 is routed through the hole 237 in the optional top tab 236 and disposed across the front wall 225 of the bracket 215 as shown in FIG. 3. The link element 220 is securely attached to the bracket 215 by folding the tab 240 across the wire 255, aligning the hole 241 (FIG. 2) with the front hole 239 (FIG. 2), and securing the tab 240 to the front wall 225 by a machine screw 270 or other similar fastener as shown in FIG. 3. Preferably the machine screw 270 has a short length sufficient to securely engage the tab 240 to the front wall 225 while minimizing contact with sheet material (not shown) adjacent the front wall 225.

Figure 4:
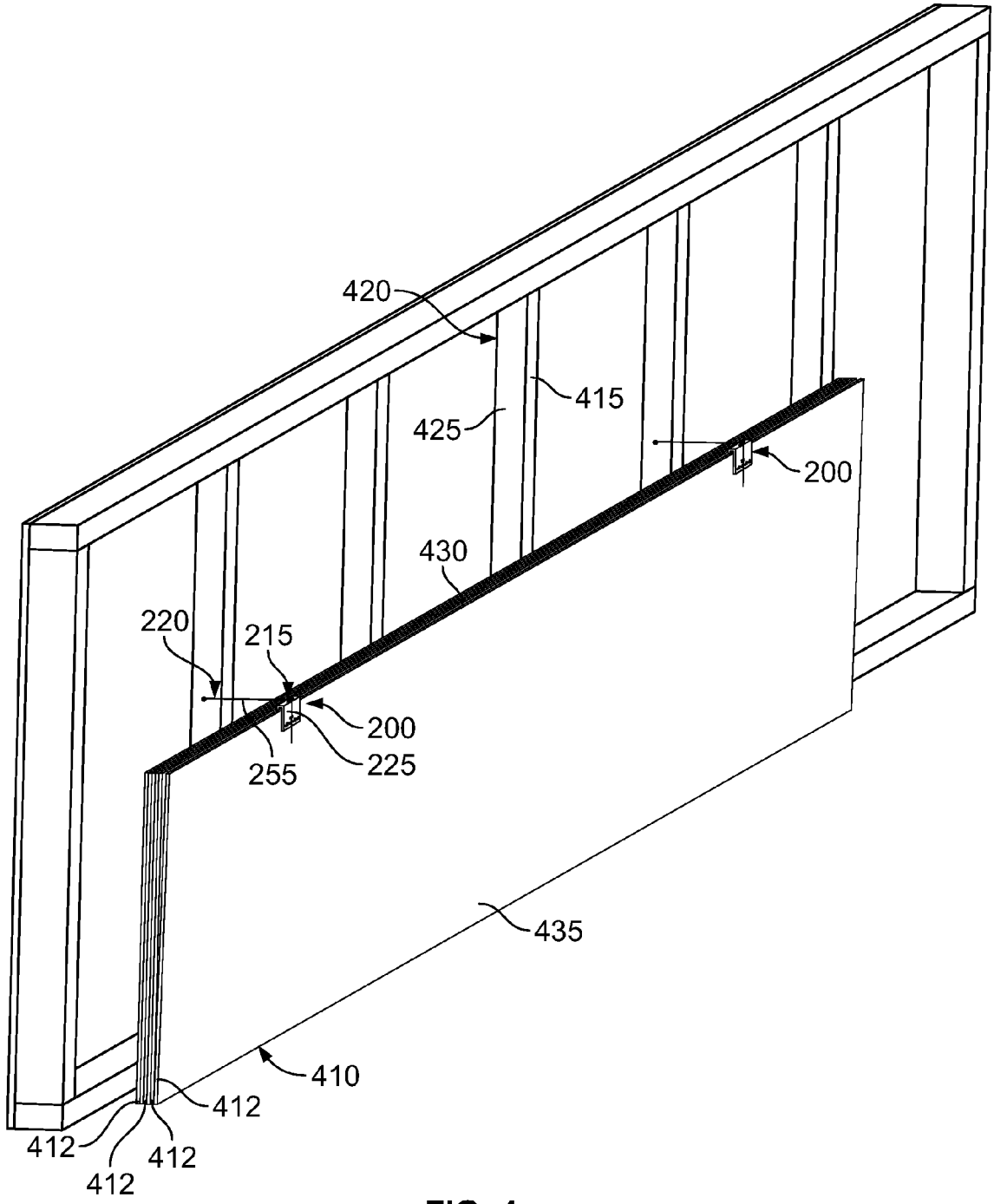
FIG. 4 illustrates an exemplary application of the invention.

FIG. 4 illustrates an exemplary embodiment of using stabilization system 200 to stabilize a bundle 410 of individual sheets of wallboard 412 that has been vertically disposed against front surfaces 415 of studs 420. The bundle 410 may include 26 to 30 individual sheets of wallboard 412 having a thickness of between about ¼ inch and about 1 inch, although fewer sheets are depicted for illustration purposes. The wallboard is configured as a 4 ft. by 12 ft. sheet, however it should be appreciated by one of ordinary skill in the art that the wallboard may be configured as a 4 ft. by 8 ft. sheet, a 4 ft by 16 ft. sheet, or other sized sheet as known in the art. It should also be appreciated by one of ordinary skill that fewer or greater than 26 to 30 individual sheets may be stabilized by the stabilization system 200.

As can be seen in FIG. 4, the flexible link element 220 has been attached to a side surface 425 of a stud 420, and the bracket 210 has been mounted over a top edge 430 of an outer sheet 435 of the bundle 410. The flexible link element 220 has been attached to the side surface 425 by a fastener (not shown) such as a screw, wood screw, nail, staple or other similar fastener. The tab (not shown) has been folded over the wire 255 and secured to the front wall 225, which secures the wire 255 to the front wall 225. As can be appreciated from FIG. 4, very little of the force from the weight of the bundle 410 is applied to the stabilization system 200 because of the substantially vertical orientation of the bundle of wallboard 410 as shown. In this exemplary embodiment, two stabilization systems 200 have been used to provide increased safety and redundancy. Alternatively, one or more than two stabilization systems 200 may be used to provide the degree of safety desired.

Several exemplary methods may be used to remove individual sheets 430 from the bundle 410. In one exemplary embodiment, the link elements 220 may be cut between the bracket 210 and the wire fasteners 260 to provide access to individual sheets of wallboard 412. In a second exemplary embodiment, the screws (not shown) attaching the wire fastener 260 to the studs 420 may be removed from the studs 410 providing access to individual sheets of wallboard 412. In a third exemplary embodiment, the fastener securing the front tab to the front wall 225 may be loosened or removed, allowing the wire 255 of the link element to be unsecured from the bracket 210 to provide access to the wallboard 412.

It should be appreciated by one of ordinary skill in the art, that in any of the exemplary methods presented above, that the wire of the flexible link element may be re-attached to brackets 210 present on the front sheet, or that new brackets 210 may be disposed on a new front sheet and existing or new wire may be used to re-attached the bracket to the studs 420.

Figure 5:
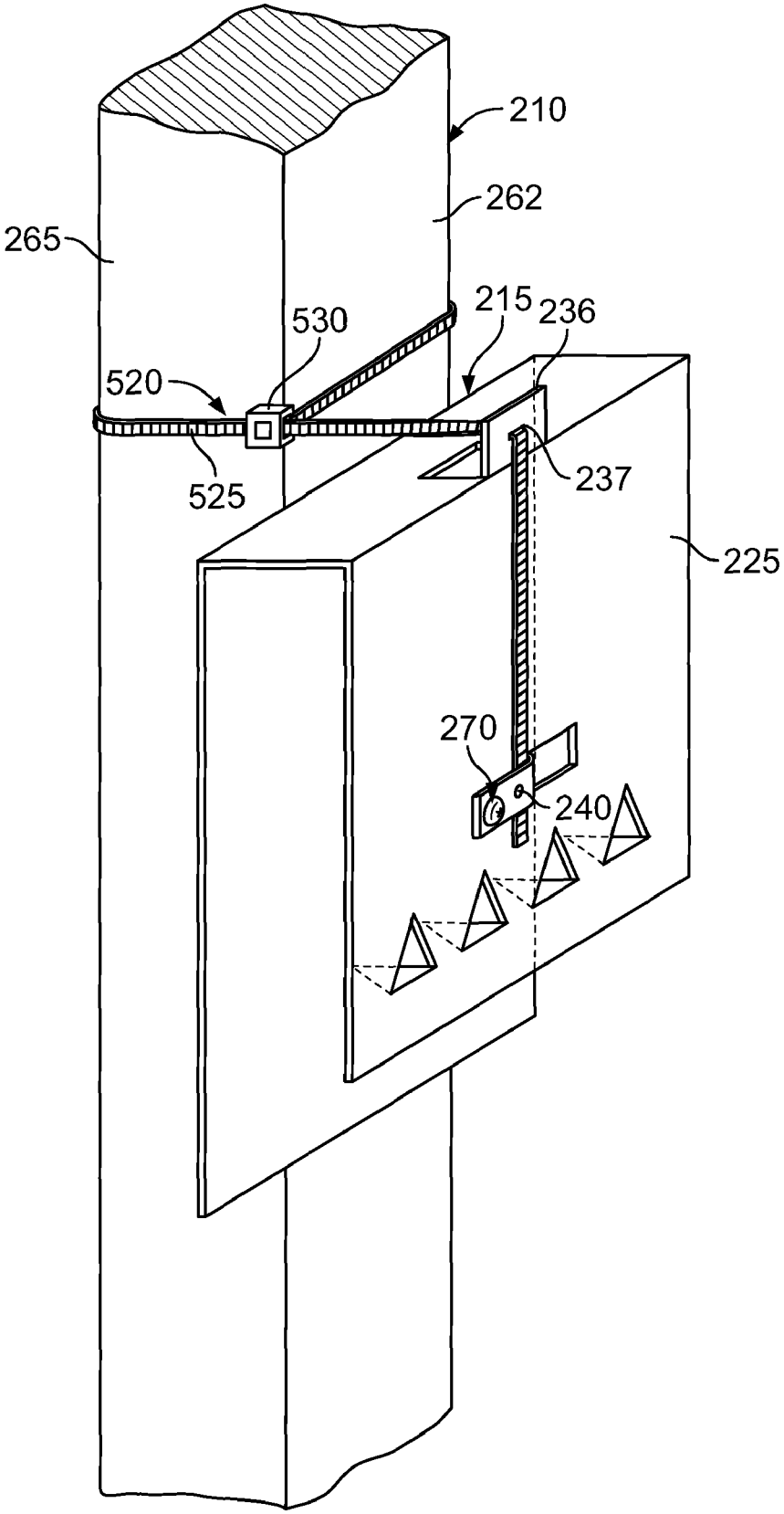
FIG. 5 illustrates an alternative exemplary embodiment of the invention.

In an alternative embodiment of the invention shown in FIG. 5, a nylon fastener 520 having a wire portion 525 and a ratcheting end section 530 disposed at one end of the wire portion 525 is as the flexible link element. The wire portion 525 is wrapped around a stud 210 and secured thereto by passing a free end of the wire portion 525 though the ratcheting end section 530 and tightened as shown in FIG. 5. The wire portion 525 is brought across the front wall 225 of bracket 215, similar to the embodiments discussed above, and secured to the bracket 215 in a similar manner as discussed above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A stabilization system for stabilizing a vertically oriented sheet of material, comprising a bracket comprising a front wall, a rear wall, and a top wall disposed between the front wall and the rear wall;

the front wall comprising a compliant tab having a first hole formed therethrough, and a second hole configured to be aligned with the first hole when the compliant tab is folded across the front wall; and an elongated flexible link element configured to attach the bracket to a structure;

wherein the top wall comprises a compliant top tab having a hole.

2. The system of claim 1, wherein the front wall further comprises protrusions generally directed towards the rear wall.

3. The system of claim 1, wherein the rear wall comprises protrusions generally directed towards the front wall.

4. The system of claim 1, wherein the elongated flexible link element comprises a wire having a wire fastener disposed at one end thereof.

5. The system of claim 4, wherein the wire is a metal wire and the wire fastener comprises an eyelet.

6. The system of claim 1, wherein the elongated flexible link element is a nylon fastener.

7. The system of claim 1, wherein the bracket comprises a plastic or polymer material.

8. The system of claim 1, wherein the bracket comprises a metal.

9. The system of claim 8, wherein the bracket is formed by stamping and forming a metal blank.

* * * * *